US008783080B2

(12) United States Patent
Koller et al.

(10) Patent No.: US 8,783,080 B2
(45) Date of Patent: Jul. 22, 2014

(54) METHOD AND DEVICE FOR MACHINING A TOOTHING ON A SINTERED PART

(75) Inventors: Johannes Koller, Vorchdorf (AT); Helmut Pamminger, Voecklabruck (AT); Horst Roessler, Wels (AT); Guenther Winterbacher, Vorchdorf (AT)

(73) Assignee: Miba Sinter Austria GmbH, Laakirchen (AT)

( * ) Notice: Subject to any disclaimer, the term of this patent is extended or adjusted under 35 U.S.C. 154(b) by 703 days.

(21) Appl. No.: 12/450,419

(22) PCT Filed: Mar. 21, 2008

(86) PCT No.: PCT/AT2008/000103

§ 371 (c)(1), (2), (4) Date: Nov. 25, 2009

(87) PCT Pub. No.: WO2008/116243

PCT Pub. Date: Oct. 2, 2008

(65) Prior Publication Data

US 2010/0064755 A1 Mar. 18, 2010

(30) Foreign Application Priority Data

Mar. 28, 2007 (AT) ..... A 484/2007

(51) Int. Cl.

| | |
|---|---|
| ***B21D 15/00*** | (2006.01) |
| ***B22F 5/08*** | (2006.01) |
| ***B22F 3/24*** | (2006.01) |
| ***B21H 5/02*** | (2006.01) |
| *B23P 15/10* | (2006.01) |
| *B21D 5/00* | (2006.01) |
| *B21B 1/10* | (2006.01) |
| *B21B 27/00* | (2006.01) |

(52) U.S. Cl.

CPC ..... *B21H 5/022* (2013.01); *B22F 2999/00* (2013.01); *B22F 5/08* (2013.01); *B22F 3/24* (2013.01)

USPC ..... 72/108; 72/74; 72/82; 72/102

(58) Field of Classification Search

USPC ..... 72/102, 108, 103, 104, 105, 106, 107, 72/110, 111, 73, 74; 29/893.32; 470/84, 470/204

See application file for complete search history.

(56) References Cited

U.S. PATENT DOCUMENTS

| | | | |
|---|---|---|---|
| 1,642,179 | A | 9/1927 | Schurr |
| 1,697,823 | A | 1/1929 | Schurr |

(Continued)

FOREIGN PATENT DOCUMENTS

| | | |
|---|---|---|
| DE | 560 568 | 10/1932 |
| DE | 31 27 770 | 10/1982 |

(Continued)

OTHER PUBLICATIONS

Fette Rolling Systems catalogue, Jul. 2005, Germany, pp. 220-221 and 242-246.

(Continued)

*Primary Examiner* — Edward Tolan
*Assistant Examiner* — Lawrence Averick
(74) *Attorney, Agent, or Firm* — Collard & Roe, P.C.

(57) ABSTRACT

The invention describes a method of machining a toothing (7) on an outer circumference (6) or an inner circumference of a work piece (2) made of pressed and sintered powder metal, by means of a rolling process carried out on the toothing (7) with two rotating section rolling wheels (8) which section toothing (13) engaging in the toothing of work piece (2). The two section rolling wheels (8) are rotatably arranged in a common support frame (10) with an at least approximately constant distance between their section rolling wheel axles (9).

24 Claims, 2 Drawing Sheets

(56) References Cited

U.S. PATENT DOCUMENTS

| | | | | | |
|---|---|---|---|---|---|
| 1,745,344 | A | | 1/1930 | Schurr | |
| 2,325,237 | A | | 7/1943 | Falk | |
| 3,087,356 | A | * | 4/1963 | Newman | 72/104 |
| 3,415,091 | A | * | 12/1968 | Grob et al. | 72/104 |
| 4,045,988 | A | * | 9/1977 | Anderson | 72/108 |
| 4,309,802 | A | | 1/1982 | Jorgensen | |
| 4,322,961 | A | * | 4/1982 | Greis | 72/95 |
| 4,414,780 | A | | 11/1983 | Jorgensen | |
| 4,592,221 | A | | 6/1986 | Krueger et al. | |
| 5,711,187 | A | * | 1/1998 | Cole et al. | 74/434 |
| 5,918,495 | A | * | 7/1999 | Miyamoto et al. | 72/108 |
| 6,202,461 | B1 | * | 3/2001 | Brinkman | 72/104 |
| 6,729,171 | B2 | * | 5/2004 | Ladousse et al. | 72/108 |
| 2003/0226386 | A1 | * | 12/2003 | Ladousse et al. | 72/108 |
| 2004/0060335 | A1 | * | 4/2004 | Allart et al. | 72/104 |
| 2005/0181710 | A1 | | 8/2005 | Linnenbrink | |
| 2007/0044533 | A1 | * | 3/2007 | Hofmann et al. | 72/249 |
| 2008/0201951 | A1 | | 8/2008 | Kotthoff | |
| 2008/0282544 | A1 | * | 11/2008 | Lawcock et al. | 29/893.32 |

FOREIGN PATENT DOCUMENTS

| | | |
|---|---|---|
| DE | 691 05 749 | 5/1995 |
| DE | 10 2005 027 054 | 12/2006 |
| EP | 0 115 012 | 8/1984 |
| EP | 0 552 272 | 7/1993 |
| EP | 1 574 286 | 9/2005 |
| GB | 2 149 703 | 6/1985 |
| GB | 2 250 227 | 6/1992 |
| JP | 58-013427 | 1/1983 |
| JP | 11-151542 | 6/1999 |
| JP | 2001-30035 | 2/2001 |
| JP | 2001-131610 | 5/2001 |
| JP | 2001-239342 | 9/2001 |
| WO | WO 92/05897 | 4/1992 |

OTHER PUBLICATIONS

International Search Report.

* cited by examiner

METHOD AND DEVICE FOR MACHINING A TOOTHING ON A SINTERED PART

CROSS REFERENCE TO RELATED APPLICATIONS

This application is the National Stage of PCT/AT2008/000103 filed on Mar. 21, 2008, which claims priority under 35 U.S.C. §119 of Austrian Application No. A 484/2007 filed on Mar. 28, 2007. The international application under PCT article 21(2) was not published in English.

The invention relates to a method and device for machining a toothing on the outer circumference or inner circumference of a work piece made of pressed and sintered powder metal in accordance with the disclosure herein, as well as a work piece of pressed and sintered sinter metal in accordance with the further disclosure herein.

After sintering, pressed and subsequently sintered work pieces made of metal powder exhibit a more or less pronounced porosity due their process of manufacturing. Particularly in the case of toothed wheels, toothed belt wheels or toothed chain wheels and suchlike, this porosity results in a reduction in repeated flexural strength in the area of the base of the teeth and reduced wear resistance in the area of the tooth flanks. In addition, depending on the composition of the powder metal as well as the process parameters during pressing and sintering, sintered work pieces experience more or less pronounced dimensional changes due to shrinkage or growth during the sintering process. In the case of work pieces with high precision requirements the dimensional and geometric accuracy achieved after the sintering process may not yet be sufficient in some cases. In order to avoid these drawbacks it is known to subsequently treat the surface of pressed and sintered powder metal work pieces by rolling. By means of such rolling, compressing of a surface layer of the sintered work piece takes place on the one hand, whereby the permanent strength as well as wear resistance are increased, and on the other hand dimensional and geometric deviations can be reduced.

Such subsequent treatment of toothed wheels made of pressed and sintered powder metal is known from DE 69 105 749 T2. This describes the surface treatment of toothed wheels with rolling machines, whereby their surface in the area of the teeth is compressed and over a depth of at least 380 inn a compression of the order of 90 to 100% is achieved. In the described single and twin rolling machine a toothed wheel to be machined is rotatably placed on a fixed axle and a section rolling wheel, which is arranged on a movable, driven axle, is brought into contact therewith. The teeth of the section rolling wheel then roll along the teeth of the toothed wheel being machined and compress its surface. During rolling, a movable carriage moves the axle of the section rolling wheel radially towards the axle of the toothed wheel being machined until the required surface compression has been achieved.

A drawback of such a rolling method is that the dimensional precision and geometric accuracy of the work pieces achievable by the rolling process is strongly dependent on the initial precision of the sintered work piece and the dimensional and geometric precision of the section rolling wheel. For example, a deviation in the shape of the sintered work piece, e.g. a conicity in the axial direction, can only be reduced by considerable adjusting forces exerted by the rolling machine and acting on the movable carriage, as the strengthening of the work piece surface brought about by compression counteracts a necessary geometric correction.

In order to achieve better geometric and dimensional accuracy of the toothing, there are methods in which during rolling treatment two or more section rolling wheels are simultaneously in contact with the work piece. The devices used for this are costly special designs with section rolling wheels that can be adjusted relative to each other along guides and by means of adjusting drives in order to adapt to different work piece dimensions.

On the basis of this state of the art it is the aim of the invention to provide a method of roller machining a toothing of a work piece made of pressed and sintered powder metal, in which correction of geometric deviations and dimensional deviations on the sintered work piece is made possible by simpler means.

This aim of the invention is achieved by a method with the measures described herein and a device with the features described herein. The surprising advantage of the use and/or arrangement of two section rolling wheels in a common holder frame in accordance with the invention is that the rolling tool is very simply constructed and has no special devices for adjusting the section rolling wheels with regard to each other. Slight geometric and/or dimensional deviations of a section rolling wheel can be reduced and/or cancelled out by the other section rolling wheel, as the finished rolled work piece surface is, so to speak, a mean value of machining by the two section rolling wheels. Particularly through the use of precisely two section rolling wheels in a rolling machine, with this work piece partial diameters of various sizes can be treated without the section rolling wheels and/or the section rolling wheel axles having to be moved relative to each other. The holder frame can therefore be designed in a simple and robust manner, for example, of two parallel plates at a distance from one another.

A variant of the method in accordance with the invention consists in carrying out an oscillating relative movement in the axial direction between the work piece and the section rolling wheels during the rolling process. The effect of this oscillating relative movement in the axial direction between the work piece and the section rolling wheels is that material displacement on the surface of the work piece is considerably facilitated thereby. In addition to the radial compressive stresses in the method according to the invention, axial shear stresses occur on the work piece surface, whereby the plastic deformability of the sintered work piece is better utilised and, particularly in the axial direction, improved material displacement and therefore overall improved levelling out of geometric deviations, and indirectly also dimensional deviations is possible.

The amplitude of the oscillating relative movement, i.e. the axial relative displacement between the work piece and the section rolling wheel, can be in particular at least 0.5 mm, which brings about a pronounced sliding effect on the surfaces in contact with each other and optimal utilisation of the plastic deformability of the material of the sintered work piece.

The method can advantageously also be implemented in that during the on-going rolling process alternating step-wise reduction in the distance between the rotating axle of the work piece and that of the rolling tool, and one or more cycles of relative movement in the axial direction between the work pieces and the section rolling wheels takes place. In this way, especially with a constant axial distance the entire toothing of the work piece can be fully roller treated once with constant maintenance of the relative movement before the next reduction in the axial distances takes place. This procedure is similar to the alternation between the in-feed movement and advancing movement in the plain turning of a turned part.

So that the teeth of the work piece toothing attain the same properties on both tooth flanks, it is advantageous if the rolling process is carried out with at least one reversal in the direction of rotation. This ensures that on both flanks of a tooth approximately the same plastic deformation occurs and, accordingly, similar geometric and mechanical properties are achieved.

Before the actual rolling process the section rolling wheels are advantageously approached in the radial direction up to the point of contact with the work piece, whereby the toothing of the work piece engages with the section toothing of the section rolling wheels. In the case of axially bringing together the two sets of toothing, costly precautions would be necessary to adjust the relative rotating position of the work piece and section rolling wheel so that a tooth of the work piece does not come into contact with a tooth of a section rolling wheel. In a radial approaching movement the free rotatability of the section rolling wheels in the rolling tool largely prevents two tooth heads colliding with each other. As an additional safeguard against a collision of this type a section rolling wheel axle can be borne in a movable and sprung manner with regard to the work piece, thereby additionally facilitating the mutual engaging of the toothings.

A variant of the method consists in a driving torque for the rolling process being exerted by a rotary actuator device directly on the work piece. This can take place through the rotary actuator device for carrying out the rolling process being directly connected to a holder for the work piece. In this case the rolling tool does not need a actuator device for the section rolling wheels and can be assembled in a simple manner. Alternatively the drive can also act on the section rolling wheels and the work piece without the drive being rotatably borne.

The rotary actuator device can, by means of a suitable holder, simultaneously hold the work piece and bring about the rotating bearing of the work piece. The functions holding and driving of the work piece can thereby be implemented by means of a single holder, although it is of course also possible to hold the work piece with one holder and drive it with a rotary actuator device that is independent of the holder.

For the rolling treatment of helically toothed work pieces it is also possible for the rolling process to be carried out with section rolling wheels with helical toothing. In this case, as in the case of straight toothed work pieces, the section rolling wheel axles can be arranged in parallel to the rotary axle of the work piece.

One possibility of differently forming the tooth shape of work piece over the width consists in the section rolling wheel axles being set obliquely to the rotary axle. Thus, for example, the compression of the work piece toothing in the middle of the work piece width can be increased compared to the peripheral area, i.e. the tooth thickness at the periphery is slightly thicker due to less compression than in the middle of the work piece. Equally the tooth shape on the work piece can be influenced by special shapes of the section rolling wheels and/or their toothing. For example, through an almost concave design of the toothing of the section rolling wheels a convex, i.e. crowned shaped of the work piece toothing can be brought about.

The rolling process can be advantageously carried out in that on the surface of the toothing of the work piece compression to over 95% of the density of the powder metal without pores, i.e. the density of the full material, takes place. With compression of this type, in addition to the correction of dimensional and geometric deviations and increase in the tooth strength and wear resistance is achieved.

In order to bring out the above-described axial relative movement between the work piece and the section rolling wheels, in the device the section rolling wheels and/or the holder with the work piece can be designed to be adjustable in an oscillating manner in an at least approximate axial direction vis-à-vis the rotary axle by an adjusting device.

It is of advantage to the even loading of both section rolling wheels if the rolling tool or the supporting frame is borne about pivoting axle parallel to the rotary axle of the holder and/or the work piece.

A compact design of the rolling tool is achieved if the ratio of a partial diameter on the toothing of a work piece being machined to the partial diameters on the section rolling wheels is selected with a lower limit of 1.0 and an upper limit of 3.5, i.e. that the section rolling wheels are smaller than the work piece. Through the smaller dimensions of the section rolling wheels the higher manufacturing costs for a design with smaller dimensional and geometric tolerances are no brought to bear so strongly, as a result of which with lower tool costs a high dimensional and geometric accuracy of the work pieces can be achieved. The two section rolling wheels can have the same partial diameter, but also different dimensions, both in terms of their partial diameter and their axial lengths.

For the design of the tool it is also advantageous if the ratio of the partial diameter of the section rolling wheels to an axial distance between the two section rolling wheel axles is selected with a lower limit of 0.25 and an upper limit of 0.75. Together with the previously mentioned size ratio between the work piece and the section rolling wheel, a favourable arrangement of the work piece between the two section rolling wheels is achieved.

Another favourable arrangement of a work piece with regard to the section rolling wheels is achieved if two planes directed from the rotary axle of the work piece through the two section rolling wheel axles comprise an angle selected from a range with a lower limit of 60° and an upper limit of 170°. In this way, even with a constantly maintained distance between the section rolling wheel axles, work pieces with different partial diameter of the toothing can be machined, whereas in the case of an angle of 180° the distance between the two section rolling wheel axles has to be adjustable.

The method of roller machining in accordance with the invention is particularly suitable for toothings with small teeth sizes as in this case the method is an economic alternative to the calibration methods which are also used for the subsequent treatment of sintered work pieces. Particularly in the case of large numbers of teeth and small tooth dimensions, and accordingly, small tolerances, the manufacturing of suitable calibration is very time-consuming and cost-intensive, for which reason the method is particularly beneficial if the toothing of the work piece and the section rolling wheels has a tooth height which is selected from a range with a lower limit of 0.5 mm and an upper limit of 5 mm.

The toothing of section rolling wheels is designed as a rolling counter-profile to the tooth profile of the work piece, which can be in the form of a toothed belt profile or an evolvent toothing profile, whereby sufficiently suitable geometries for these profiles are known from the state of the art.

Although it is possible for a section rolling wheel to be narrower than the toothing on the work piece being machined, it is advantageous if the section rolling wheels have an axial toothing length that is greater than an axial toothing length on the work piece. This ensures that in end edges of the section rolling wheels there is no scouring removal of sinter material during the axial relative movement. To avoid such abrasion the ends edges of the section rolling wheels can be bevelled or rounded.

The adjusting device for bringing about the axial relative movement of the section rolling wheels and/or adjusting the distance between the rotating axle of the work piece and the section rolling wheel axle is advantageously designed as a numerically controlled adjusting axle of a machining device.

The invention will be described in more detail below with the aid of the example of embodiment shown in the drawings:

In simplified and schematic illustrations

As an introduction is should be stated that in the various described embodiments, the same parts are given the same reference number and/or part designations, whereby the disclosures in the overall description are accordingly transferable to the same parts with the same reference numbers and/or the same part designations. The position details used in the description, e.g. at the bottom, at the side etc. relate to the directly described and shown figure and can be transferred accordingly in the event of a position change. Individual features of combinations of from the different shown and described examples of embodiment can also represent solutions that are separate, inventive or in accordance with the invention.

All details relating to values in the present description are to be understood in such a way that they include any and all partial amounts thereof, e.g. the indication 1 to 10 is understood to mean that all partial ranges starting from the lower limit 1 up to the upper limit 10 are included, i.e. all partial ranges with a lower limit of 1 or more and ending with an upper limit of 10 or less, e.g. 1 to 1.7, or 3.2 to 8.1 or 5.5 to 10.

Figure 1:
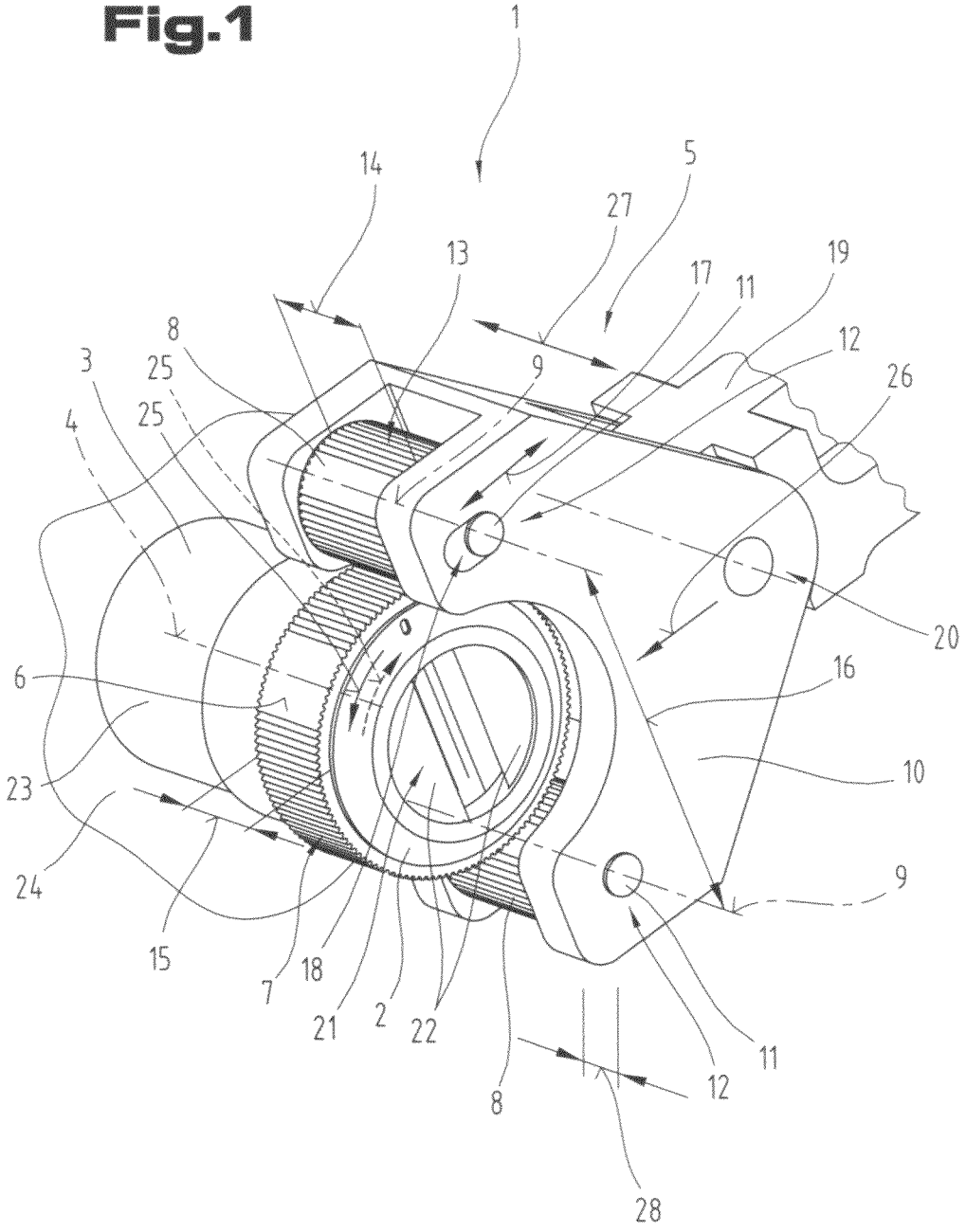
FIG. 1 shows a perspective view of a work piece on a holder engaged with a rolling tool of a device in accordance with the invention.

FIG. 1 shows a perspective view of a device 1 for the rolling machining of a work piece 2 made of pressed and sintered powder metal. The device 1 comprises a holder 3, to which the work piece 2 is attached for carrying out the rolling treatment and is rotatable about a rotary axle 4, as well as a rolling tool 5 with which the toothing 7 arranged on an outer circumference 6 of the work piece 2 is machined by rolling.

The rolling tool 5 comprises two section rolling wheels 8 which are each borne in a rotatable manner about a section rolling wheel axle 9 in the rolling tool 5. This takes place in a support frame 10 which can be designed in one piece and accordingly exhibits a high degree of strength and/or rigidity. Structurally a section rolling wheel axle 8 can be formed by kingpins that project axially on the section rolling wheels and are placed in corresponding bearing points 12 on the support frame. The kingpins 11 can for example be formed in one piece on the section rolling wheel 8, but also by a separate axle element that is introduced into the section rolling wheel 8.

On their outer circumference the section rolling wheels 8 are provided with section toothing 13 which extends over the entire circumference of the section rolling wheels 8 and has an axial toothing length 14 in the direction of the section rolling wheel axle 9. This toothing length 14 is, as shown in FIG. 1, greater than a toothing length 15 of the toothing 7 on the work piece 2. In the shown example of embodiment the section rolling wheel axles 9 of the section rolling wheels 8 are arranged in parallel to the rotary axle 4 of the work piece 2, although in a departure from this, embodiments of a rolling tool 5 are possible in which the section rolling wheel axles 9 are arranged slightly askew with regard to the rotary axle 4. The two section rolling wheel axles 9 are at an axial distance relative to each other that is essentially constant. This ensures that the bearing points 12 on the support frame 10 are not adjustable with regard to each other but are arranged in a fixed manner. A minimal change in the axial distance 16 can be brought about in that a section rolling wheel axle 9—the section rolling wheel axle shown at the top in figure—is arranged movably on the support frame 10 in an at least approximately tangential direction 17 with regard to the second section rolling wheel axle 9, the lower section rolling wheel axle in FIG. 1. For this the bearing point 12 in the movable section rolling wheel axle 9 can be in the form of a slot 18 in which the kingpins 11 of the section rolling wheel can move in an approximately tangential direction 17 with regard to the other section rolling wheel axle 9. The slot 18 can for example be formed by producing an elongated hole in the support frame 10 instead of a conventional drill hole.

Alternatively to the described embodiment, both section rolling wheel axles 9 can be borne movably in the same way on the support frame 10.

The rolling tool 5 is fastened with its support frame 10 to a tool holder of a machining device which is not shown. This fastening can be rigid, but also exhibit mobility between the support frame 10 and the tool holder 19, in that a pivot bearing 20 is arranged between the support frame 10 and the tool holder 19. The possible pivoting angle for this movable bearing is limited by stable stops and kept within a range of a few angular degrees, as too great mobility at this bearing could negatively affect the stability of the rolling tool 5 during operation.

In the shown example of embodiment the holder 3 to which the work piece 2 to be machined can be attached comprises a mandrel 21, to which the work piece 2 can be braced on an internal diameter. For this the mandrel 21 comprises two or more bracing elements 22 which can be pressed against the inner diameter of the work piece 2 by means of a bracing device, which is not shown, as a result of which a concentric positioning of the work piece 2 with regard to the rotating axle 4, and at the same time a torsion-free connection between the work piece 2 and holder 2 is brought about. The holder 2 is arranged on a driven spindle 23 which is connected to an actuator device 24, only sections of which are shown.

In the following a possible variant in the process of implementing the method of machining the toothing 7 of the work piece 2 in accordance with the invention is described. Before beginning the process, the work piece 2 is placed on the mandrel 21 in the direction of the rotary axle 4 and fixed thereto with the aid of the bracing elements 22. The rolling tool 5 is positioned at an adequate distance from the rotary axle 4. After the work piece 2 has been attached to the holder 3, the rolling tool 5 is brought into the machining position. For this the support frame 10 with the two section rolling wheels 8 is brought towards the rotary axle 4 by means of the tool holder 19 in an at least approximately radial manner in relation to the rotary axle 4, as a result of which the section toothing 13 of the section rolling wheels 8 engages with the toothing 7 of the work piece 2. During this the work piece 2 is preferably still at a standstill, but it can already execute a rotary movement about the rotary axle 4. Due to the free movement of the section rolling wheels 8 the teeth of toothing 7 easily find their way into the spaces between the teeth of the section toothing 12 as the rolling tool 5 approaches the work piece 2. As it can happen in exceptional cases that the head of a tooth of the section rolling wheel 8 coincides exactly radially with the head of a tooth of toothing 7 of the work piece, which would thereby block the mutual engaging of the toothings, the additional mobility of section rolling wheel axle 9 with regard to the support frame 10 supports the mutual engaging of the section toothing 13 in the toothing 7.

After engaging of the section rolling wheels 8 in the toothing 7 of the work piece 2, the latter, together with the holder, is rotated by means of a rotary actuator device 24, whereby the two section rolling wheels 8 roll along the toothing 7. The rotary movement takes place, for example in a first direction of rotation 25.

So that the required rolling reshaping processes can take place on the toothing 7, appropriate rolling forces must act between the section toothing 13 and the toothing 7, which are brought about by means of a force being exerted on the rolling tool 5 at least approximately in a radial direction 26 in the direction of the rotary axle 4. This takes through the tool holder 19 being pushed in a radial direction 26 by an appropriate force. This force applied in the radial direction 26 brings about the rolling forces acting between the work piece 2 and the section rolling wheels 8, which depending on dimensional relationship, more particularly on the diameter ratios, can take on very high values.

During the rolling process by the section rolling wheels 8 taking place through rotation of the work piece 2, by way of the profile of the section toothing 13, the toothing 7 is improved in terms of its dimensional and geometric accuracy as well as surface density. For example, a correction of dimensional deviations can take place in that on the toothing 7 the tooth thickness and/or tooth heights are corrected through slight plastic deformation; a correction of dimensional deviations is possible for example through a conicity in the direction of the rotary axle 4 or a concentricity on the tooth head circumference or tooth base circumference being improved. Through the surface compression the wear-resistance of the tooth flank or the tooth base strength can be improved for example.

In order to facilitate these elasto-plastic reshaping processes, it is also possible to superimpose a relative movement in the direction of the rotating axle 4 between the toothing 7 and the section toothing 13, whereby in addition to the essentially radially acting rolling forces, axially acting friction forces become effective, and though the multi-axle nature of the stressing conditions on the surface of the toothing, the plastic deformability of the work piece material can be better utilised. This relative movement can be brought about, for example, through the rolling tool 5 executing an oscillating movement in an axial direction 27 parallel to a rotary axis 4. An amplitude 28 of this oscillating vibrating movement is at least 0.5 mm so that pronounced axial sliding can occur between the interacting toothings.

The rolling forces occurring during the rolling process can be controlled in that the force exerted by the rolling tool 5 on the work piece 2 is regulated by the force acting on the tool holder 19, for example in an increasing linear or stepped manner. Alternatively, it is however possible to adjust the rolling force in such a way that starting from an initial position of the rolling tool 5, it approaches the rotating axle 4 during the rolling process in defined steps and the rolling forces adjust accordingly. In the second method the rolling forces acting between the section rolling wheels 8 and the work piece 2 decrease if the distance between the rolling tool 5 and rotating axle 4 is kept constant as a result of the plastic deformation process, until the rolling tool 5 is again brought closer to the rotating axle 4 by a small adjusting step. The rolling process can therefore be carried out in a force-controlled and distance-controlled manner.

On completion of the rolling process, which for example, is determined by the achievement of a certain maximum rolling force or the attainment of a defined minimum distance of the rolling tool from the rotary axle 4, or after a certain number of revolutions of the work piece 2 at a certain force and/or distance setting, the rolling tool 5 is distanced again from the work piece 2 contrary to the radial direction, and after loosening of the bracing elements 22 can be removed from the holder 3.

During the rolling process it is also possible to reverse the direction of rotation 25 at least once, as indicated in FIG. 1 by a dashed arrow for the reverse direction of rotation 25. In this way the individual teeth of the toothing are rolling treated to an equal extent on both tooth flanks, by way of which a symmetrical improvement in the toothing properties is achieved to a certain extent.

The example of embodiment in accordance with FIG. 1 shows a work piece with straight toothing 7 and accordingly the section toothing 13 of the section rolling wheels 8 is also straight. However, in a departure from this it is also possible to modify the method and/or device 1 in such a way that work pieces 2 with helically cut teeth can also be treated. This can be achieved through the section toothing 13 of the section rolling wheels 8 being designed as helically cut toothing.

If the described method is used for the rolling machining of an inner toothing of a work piece 2 made of pressed and sintered powder metal, it easy for a person skilled in the art to appropriately modify the above-described processing measures for this case. Obviously in this case the rolling tool 4 must be introduced axially in the area of the toothing 7, and furthermore during the course of rolling the distance between the rotating axle 4 and the rolling tool 4 is increased in order to achieve the desired rolling forces. In the case of inner machining the section rolling wheels 8 are preferably designed to be smaller than for outer machining in order to be able to cover various partial diameter areas of the work pieces 2.

Figure 2:
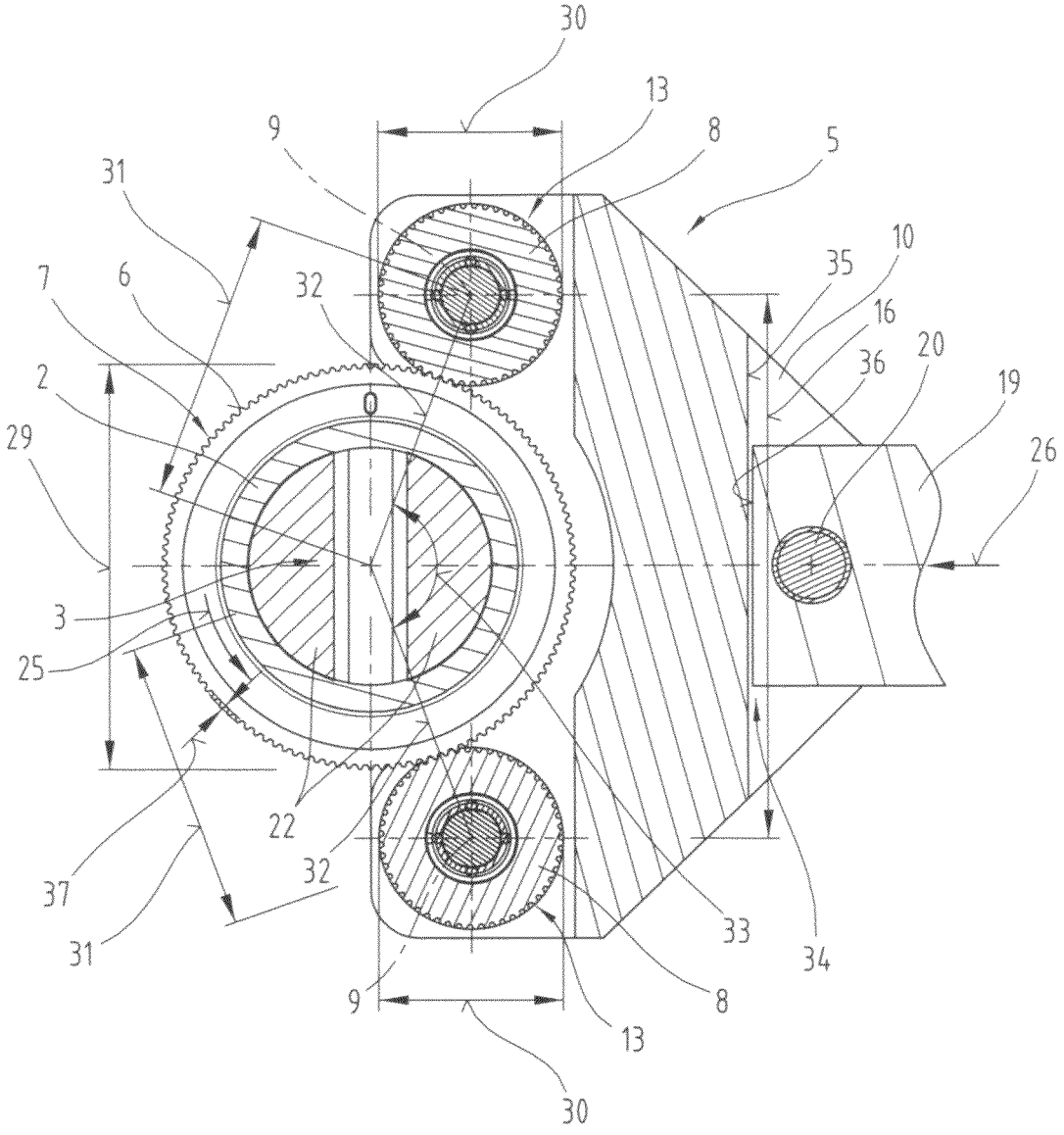
FIG. 2 shows a cross section of the work piece with the engaging rolling tool in accordance with FIG. 1.

FIG. 2 shows a cross-section of the device in accordance with FIG. 1 with the work piece 2 as well as the roller tool 5 in the operational position in which the section toothing 13 of the section rolling wheels 8 are engaged with the toothing 7 on the outer circumference 6 of the work piece 2.

In the following the geometric relationships between the work piece 2 and roller tool 5 that influence the implementation of the process are considered.

The toothing 7 of the work piece 2 has a partial diameter 29 that in the shown example of embodiment corresponds to approximately twice that of the partial diameter 30 of the section toothing 13 of the section rolling wheels 8. A distance 31 measured from the rotary axle 4 to a section rolling wheel axle 9 corresponds to half the sum of the partial diameter 29 of the work piece 2 and the partial diameter 30 of the considered section rolling wheel 9.

Together with the essentially constant axle distance 16 between the two section rolling wheel axles 9, the position of the rolling tool 5 when engaging with the work piece 2 is pre-determined by the partial diameters 29, 30 and the distance 16 between the axles, if the slight changes in the dimensions on the work piece 2 though the rolling are disregarded.

Between two planes 32 that can be directed from the rotary axle 4 through the two section rolling axles 9 an angle of spread 33 is formed which approximately corresponds to the angle between the two rolling forces exerted essentially radially on the work piece 2 by the section rolling wheels 8.

In the shown example of embodiment the partial diameters 30 of the section rolling wheels 8 are selected to be of equal size, but the two section rolling wheels can also have differing partial diameters 30.

The ratio of the partial diameter 29 of the work piece 2 and the partial diameters 30 of the section rolling wheels 8 is preferably selected from a range with a lower limit of 1.0 and an upper limit of 3.5. Furthermore, the ratio between the partial diameters 30 of the section rolling wheels 8 and axle distance 16 between their section rolling wheel axles 9 is preferably selected from a range with a lower limit of 0.25 and an upper limit of 0.75.

Through the selection of the size ratio the possible range of the angle of spread 33 is also influenced, which advantageously lies between a lower limit of 60° and an upper limit of 170°. Especially at higher angles of spread 33, with an overall smaller force acting the rolling tool 5 in the radial direction 26, large radial rolling forces come into effect between the section rolling wheels 8 and the work piece 2 which have to be taken up by a robust and rigid embodiment of the support frame 10. This is achieved in the best possible way in the case of the one-piece embodiment of the support frame 10 illustrated in FIG. 1.

FIG. 2 also shows the attachment of the support frame 10 to the tool holder 19 by means of a pivoting bearing 20, whereby the possible pivoting angle is kept low through though a small amount of play between the stop surfaces 35 on the support frame 10 and the stop surfaces 36 on the tool holder 19, as a force equalization between the two section rolling wheels 8 can come about with even the smallest equalization movements of the support frame 10. This pivoting bearing movement also ensures that any pulsating forces on the support frame 10 produced through the rolling movement of the section toothing 13 with the toothing 7, are only transferred to the tool holder 19 in weakened form.

The method in accordance with the invention is very suitable for reducing dimensional and geometric deviations in work pieces 2 with a large number of relatively small teeth, as particularly in such cases it is much more advantageous than, for example, calibration by way of a high-precision manufactured calibration tool which can only be used for precisely one tool dimension. In contrast to this, with the device in accordance with the invention a whole spectrum of work piece geometries, more particularly various partial diameters 29 can be covered, whereby with low equipment costs very dimensionally and geometrically accurate toothings can nevertheless be produced on sintered work piece 3, as are required, for example, in the case of toothed belt disks for fast-acting valve drives.

Therefore a tooth height 37 of a work piece 2 produced with the method in accordance with the invention shown in FIG. 2 is preferably between 0.5 mm and 5 mm.

The example of embodiment shows one possible variant of the method and/or device 1, whereby at this point it should be pointed out that the invention is not restricted to the specially illustrated embodiment, but, that various combinations of the individually described embodiment variations are also possible and, on the basis of the teaching on technical action through the present invention, this possibility of variation forms part of the knowledge of a person skilled in this technical field. All conceivable variations of embodiment possible through the combination of individual details of the described variations of embodiment are also included in the protective scope.

For the sake of good order it is finally pointed out that for a better understanding for the structure of the device 1, it and/or its components have in parts been shown in a not to scale and/or enlarged and/or reduced manner.

The objective forming the basis of the separate inventive solutions can be taken from the description.

Above all the individual embodiments shown in FIGS. 1 and 2 can form the subject matter of individual inventive solutions. The relevant inventive aims and solutions can be taken from the detailed descriptions of these figures.

LIST OF REFERENCES

1 Device
2 Work piece
3 Holder
4 Rotating axle
5 Rolling tool
6 Outer circumference
7 Toothing
8 Section rolling wheel
9 Section rolling wheel axle
10 Support frame
11 Kingpins
12 Bearing point
13 Section toothing
14 Toothing length
15 Toothing length
16 Axle distance
17 Direction
18 Slot
19 Tool holder
20 Pivoting bearing
21 Mandrel
22 Bracing element
23 Spindle
24 Rotary actuator device
25 Direction of rotation
26 Radial direction
27 Axial direction
28 Amplitude
29 Partial diameter
30 Partial diameter
31 Distance
32 Plane
33 Spread angle
34 Play
35 Stop
36 Stop
37 Tooth height

The invention claimed is:

1. A method of machining a toothing on an outer circumference or an inner circumference of a work piece made of pressed and sintered powder metal with the work piece secured on a holder, the machining occurring via a rolling process on the toothing using two rotatable section rolling wheels, which have a section toothing engaging in the toothing of the piece, wherein the two section rolling wheels are arranged in a rotating manner in a common support frame designed in one piece, wherein the holder for the work piece is mounted on a spindle and is driven by an actuator device via the spindle such that a driving torque is transmitted to the work piece by the actuator device for the rolling process, wherein the two section rolling wheels are each freely rotatable about a respective section rolling wheel axle supported directly in the support frame so that once the two section rolling wheels are engaged in the toothing of the work piece, the section rolling wheels roll on the toothing, wherein one section rolling wheel axle is arranged movably on the support frame at least approximately tangentially with regard to the second rolling wheel axle, and wherein the moveable section rolling wheel axle is disposed in a guided slot arranged in the support frame and is directly guided in the guided slot such that the moveable section rolling wheel axle has an additional mobility with regard to the support frame, the additional mobility supporting the mutual engaging of the section toothing in the toothing, said moveable section rolling wheel axle being guided about an entire length of the guided slot.

2. The method according to claim 1 wherein during the rolling process an oscillating relative movement in the axial direction also takes place between the work piece and the section rolling wheels.

3. The method according to claim 2, wherein an amplitude of the oscillating relative movement is at least 0.5 mm.

4. The method according to claim 2, wherein during the on-going rolling process a step-wise reduction in the distance between a rotary axle of the work piece and the section rolling wheel axles, and several cycles of the relative movement in the axial direction between the work piece and section rolling wheels take place alternately.

5. The method according to claim 1, wherein the rolling process is carried out with a reversal of the direction of rotation.

6. The method according to claim 1, wherein before the rolling process the section rolling wheels with the support frame approach the work piece in a radial direction until contact takes place.

7. The method according to claim 1, wherein the rolling process is carried out with two section rolling wheels with helical toothing.

8. The method according to claim 1, wherein during the rolling process compression to over 95% of the density of the powder metal without pores takes place up to a depth of 0.3 mm on the surface of the toothing.

9. A device for the rolling treatment of a toothing on the outer circumference or inner circumference of a work piece made of pressed and sintered powder metal, the device comprising:

a holder for holding the work piece and its bearing rotatable about a rotating axle, a rolling tool with two section rolling wheels with section toothing engaging in the toothing of the held work piece in order to roll the toothing, and an actuator device, wherein the holder for the work piece is mounted on a spindle and the spindle can be driven by the actuator device, wherein the two section rolling wheels are each freely rotatable about a respective section rolling wheel axle rotatably borne and supported directly in a support frame designed in one piece so that once the two section rolling wheels are engaged in the toothing of the work piece, the section rolling wheels roll on the toothing during the rolling process, wherein one section rolling wheel axle is arranged movably on the support frame at least approximately tangentially with regard to the second rolling wheel axle, and wherein the moveable section rolling wheel axle is disposed in a guided slot arranged in the support frame and is directly guided in the guided slot such that the moveable section rolling wheel axle has an additional mobility with regard to the support frame, the additional mobility supporting the mutual engaging of the section toothing in the toothing, said moveable section rolling wheel axle being guided about an entire length of the guided slot.

10. The device according to claim 9, wherein the section rolling wheels and/or rotating holder with the work piece can be adjusted through oscillation in an axial direction at least approximately parallel to the rotating axle by means of an adjusting device.

11. The device according to claim 9, wherein section rolling wheel axles of the section rolling wheels are arranged in parallel to the rotary axle of the holder.

12. The device according to claim 9, wherein the rolling tool or the support frame are arranged on a pivoting bearing parallel to the rotary axle of the holder.

13. The device according to claim 9, wherein the ratio of a partial diameter on the toothing of the work piece to a partial diameter of the section toothing on the section rolling wheel is selected from a range with a lower limit of 1.0 and an upper limit of 3.5.

14. The device according to claim 9, wherein the ratio of the partial diameter on the section rolling wheels to the distance between the two section rolling wheel axles is selected from a range with a lower limit of 0.25 and an upper limit of 0.75.

15. The device according claim 9, wherein two planes directed from the rotating axle of the work piece through the section rolling wheel axles form an angle of spread selected from a range with a lower limit of 60° and an upper limit of 170°.

16. The device according to claim 9, wherein the toothing of the work piece and the section toothing of the section rolling wheels has a tooth height selected from a range with a lower limit of 0.3 mm and an upper limit of 3 mm.

17. The device according to claim 9, wherein the section toothing has a counter-profile to a toothed belt profile, a toothed chain profile, evolvent toothing profile or any other section toothing profile.

18. The device according to claim 9, wherein at least one section rolling wheel has an axial toothing length that is greater than the axial toothing length on the work piece.

19. The device according to claim 9, wherein an actuator device is directly connected to the holder for the work piece in order to implement the rolling process.

20. The device according to claim 9, wherein an adjusting device for bringing about the axial relative movement of the section rolling wheels and/or setting the distance between the rotary axle of the work piece and the section rolling axles is formed by a numerically-controlled adjusting axle of a machine device.

21. The device according to claim 9, wherein the section rolling wheels have helical toothing as section toothing.

22. The method according to claim 1, wherein the ratio of the partial diameter on the section rolling wheels to the axial distance between the two rolling wheel axles is selected from a range with a lower limit of 0.25 and an upper limit of 0.75.

23. The method according to claim 1, wherein the toothing of the work piece and the section toothing of the section rolling wheels have a tooth height selected from a range with a lower limit of 0.3 mm and an upper limit of 3 mm.

24. The method according to claim 1, wherein at least one section rolling wheel has an axial toothing length which is longer than an axial toothing length on the work piece.

* * * * *